US008297473B2

(12) United States Patent
Smith

(10) Patent No.: US 8,297,473 B2
(45) Date of Patent: Oct. 30, 2012

(54) CUTLERY DISPENSER AND METHOD OF DISPENSING CUTLERY

(75) Inventor: Patrick J. Smith, Iola, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 249 days.

(21) Appl. No.: 11/936,401

(22) Filed: Nov. 7, 2007

(65) Prior Publication Data

US 2008/0121650 A1 May 29, 2008

Related U.S. Application Data

(60) Provisional application No. 60/864,636, filed on Nov. 7, 2006.

(51) Int. Cl.
*A47F 1/08* (2006.01)

(52) U.S. Cl. ..... 221/129; 221/223; 221/268; 221/277

(58) Field of Classification Search ..... 221/2, 9, 221/13, 15, 175, 176, 186, 187, 189, 191, 221/194, 195, 196, 208, 221, 222, 223, 224, 221/233, 234, 258, 268, 272–275, 277, 281–284, 221/289, 290, 297–299, 311
See application file for complete search history.

(56) References Cited

U.S. PATENT DOCUMENTS

| | | | | |
|---|---|---|---|---|
| 592,105 | A | 10/1897 | Barnes | |
| 716,058 | A * | 12/1902 | Lang et al. | 221/115 |
| 925,485 | A | 6/1909 | Lafler | |
| 999,837 | A * | 8/1911 | Morris et al. | 194/255 |
| 1,146,447 | A | 7/1915 | Prommel | |
| 1,182,793 | A * | 5/1916 | Richardson | 194/255 |
| 1,259,927 | A | 3/1918 | Swift | |
| 1,355,583 | A | 10/1920 | Zeidler et al. | |
| 1,482,071 | A | 1/1924 | Duff et al. | |
| 1,504,098 | A | 8/1924 | Cathey | |
| 1,546,077 | A | 7/1925 | Hunter et al. | |
| 1,547,151 | A | 7/1925 | Watling | |
| 1,577,302 | A | 3/1926 | Schultz | |
| 1,610,001 | A * | 12/1926 | Foster | 221/202 |
| 1,675,510 | A * | 7/1928 | Nolan | 221/93 |
| 1,767,634 | A * | 6/1930 | Weiss | 221/154 |
| 1,886,378 | A * | 11/1932 | Dearsley | 221/236 |
| 2,053,828 | A | 9/1936 | Harper | |
| 2,078,984 | A | 5/1937 | Williamson | |

(Continued)

FOREIGN PATENT DOCUMENTS

CA 2545745 A1 11/2006

(Continued)

OTHER PUBLICATIONS

PCT International Search Report PCT/US2007/083752, Mar. 11, 2008.

(Continued)

*Primary Examiner* — Gene Crawford
*Assistant Examiner* — Kelvin L Randall, Jr.
(74) *Attorney, Agent, or Firm* — William W. Letson

(57) ABSTRACT

A cutlery dispenser comprises a storage chamber adapted to retain a plurality of cutlery therein; an ejector for sequentially ejecting the plurality of cutlery from the storage chamber; an actuator for driving the ejector; and a sensor for triggering the actuator in response to an event.

19 Claims, 6 Drawing Sheets

U.S. PATENT DOCUMENTS

| | | | | | |
|---|---|---|---|---|---|
| 2,110,189 | A | | 3/1938 | Zeidler, Sr. | |
| 2,141,684 | A | | 12/1938 | Diemer | |
| 2,149,098 | A | | 2/1939 | Phinney | |
| 2,149,099 | A | | 2/1939 | Phinney et al. | |
| 2,188,573 | A | | 1/1940 | Longo | |
| 2,207,528 | A | | 7/1940 | Witt | |
| 2,239,196 | A | * | 4/1941 | Lunvik | 221/131 |
| 2,260,596 | A | | 10/1941 | Young | |
| 2,268,596 | A | | 1/1942 | Jerum | |
| 2,268,873 | A | * | 1/1942 | Hopkins et al. | 221/242 |
| 2,340,561 | A | * | 2/1944 | Renfro | 312/42 |
| 2,421,782 | A | | 6/1947 | Gibbs et al. | |
| 2,427,321 | A | * | 9/1947 | Casey et al. | 221/272 |
| 2,472,051 | A | | 5/1949 | Testi | |
| 2,571,668 | A | | 10/1951 | Booth et al. | |
| 2,577,344 | A | | 12/1951 | Masure | |
| 2,635,025 | A | | 4/1953 | Ziska | |
| 2,646,874 | A | | 7/1953 | Testi | |
| 2,671,555 | A | | 3/1954 | Shnitzler | |
| 2,692,691 | A | | 10/1954 | Harriss et al. | |
| 2,752,678 | A | | 7/1956 | Welch | |
| 2,806,634 | A | * | 9/1957 | Baumgartner | 221/301 |
| 2,868,344 | A | | 1/1959 | Shields | |
| 2,877,926 | A | | 3/1959 | Abbe | |
| 2,880,907 | A | | 4/1959 | Mainers | |
| 2,889,076 | A | | 6/1959 | Van Schie | |
| 2,911,127 | A | * | 11/1959 | Driss et al. | 221/258 |
| 2,924,357 | A | | 2/1960 | Kingsley et al. | |
| 2,946,431 | A | | 7/1960 | Nissen | |
| 2,954,948 | A | | 10/1960 | Johnson | |
| 2,965,262 | A | * | 12/1960 | Du Bois | 221/115 |
| 3,083,879 | A | | 4/1963 | Coleman | |
| 3,095,114 | A | * | 6/1963 | Tobias | 221/114 |
| 3,100,842 | A | * | 8/1963 | Tellefsen | 250/455.11 |
| 3,114,475 | A | | 12/1963 | Etes | |
| 3,132,765 | A | | 5/1964 | Florendo | |
| 3,163,327 | A | | 12/1964 | Maxwell | |
| 3,263,860 | A | | 8/1966 | Haas | |
| 3,300,087 | A | | 1/1967 | Kuypers | |
| 3,313,452 | A | | 4/1967 | Katz | |
| 3,334,784 | A | | 8/1967 | Morrison | |
| 3,338,471 | A | * | 8/1967 | De Good | 221/129 |
| 3,371,821 | A | | 3/1968 | Abood et al. | |
| 3,407,927 | A | | 10/1968 | Jones | |
| 3,426,941 | A | | 2/1969 | Hovekamp | |
| 3,472,421 | A | | 10/1969 | Bailer | |
| 3,499,538 | A | | 3/1970 | Sherard | |
| 3,558,006 | A | | 1/1971 | Redmond et al. | |
| 3,587,922 | A | | 6/1971 | Oriti | |
| 3,680,736 | A | * | 8/1972 | Viessmann | 221/14 |
| 3,786,959 | A | | 1/1974 | Greb et al. | |
| 4,134,519 | A | * | 1/1979 | Barnett et al. | 221/46 |
| 4,308,974 | A | * | 1/1982 | Jones | 221/196 |
| 4,489,854 | A | * | 12/1984 | Wenkman et al. | 221/202 |
| 4,524,512 | A | | 6/1985 | Formo et al. | |
| 4,570,536 | A | * | 2/1986 | Dodd | 100/345 |
| 4,571,773 | A | | 2/1986 | Yuda | |
| 4,574,423 | A | | 3/1986 | Ito et al. | |
| 4,610,087 | A | | 9/1986 | Mickelson et al. | |
| 4,614,004 | A | | 9/1986 | Oshida | |
| 4,662,536 | A | | 5/1987 | Powers | |
| 4,691,811 | A | | 9/1987 | Arakawa et al. | |
| 4,697,673 | A | | 10/1987 | Omata | |
| 4,715,514 | A | * | 12/1987 | Vidondo | 221/258 |
| 4,789,064 | A | | 12/1988 | Segal | |
| 4,896,792 | A | | 1/1990 | Marchand | |
| 4,973,037 | A | * | 11/1990 | Holbrook | 271/2 |
| 4,986,442 | A | | 1/1991 | Hinterreiter | |
| 5,127,546 | A | * | 7/1992 | Chen | 221/242 |
| 5,131,586 | A | | 7/1992 | Capy | |
| 5,191,997 | A | | 3/1993 | Squitieri | |
| 5,211,267 | A | | 5/1993 | Clark | |
| 5,249,705 | A | * | 10/1993 | Gates | 221/6 |
| D342,648 | S | | 12/1993 | Cautereels et al. | |
| 5,269,397 | A | | 12/1993 | Kawamoto et al. | |
| 5,364,016 | A | | 11/1994 | Capy et al. | |
| 5,413,317 | A | | 5/1995 | Spoerre | |
| 5,449,054 | A | | 9/1995 | Wiese et al. | |
| 5,460,252 | A | | 10/1995 | Kosugi et al. | |
| 5,469,688 | A | | 11/1995 | Dunbar et al. | |
| 5,497,863 | A | | 3/1996 | Schmidt et al. | |
| 5,509,522 | A | | 4/1996 | Laidlaw | |
| 5,542,508 | A | | 8/1996 | Van Erden et al. | |
| 5,564,594 | A | | 10/1996 | Monfredo | |
| 5,586,685 | A | | 12/1996 | Dorner et al. | |
| 5,605,208 | A | | 2/1997 | Friedrichsen et al. | |
| 5,660,252 | A | | 8/1997 | Lafon | |
| 5,904,250 | A | | 5/1999 | De Schutter | |
| 5,921,408 | A | | 7/1999 | Groenewold et al. | |
| 6,023,913 | A | | 2/2000 | Gray et al. | |
| 6,047,830 | A | | 4/2000 | Chang | |
| 6,202,891 | B1 | | 3/2001 | Mark | |
| 6,250,498 | B1 | * | 6/2001 | Lovejoy | 221/185 |
| 6,298,960 | B1 | | 10/2001 | Derr | |
| 6,336,568 | B1 | * | 1/2002 | Tucker et al. | 221/131 |
| 6,378,729 | B1 | | 4/2002 | Kodama | |
| 6,626,633 | B2 | * | 9/2003 | Jendzurski et al. | 414/797.9 |
| 6,651,841 | B2 | | 11/2003 | Tsuchida | |
| D492,549 | S | | 7/2004 | Welch | |
| D493,337 | S | | 7/2004 | Welch | |
| 6,763,972 | B2 | | 7/2004 | Graupner | |
| 6,832,694 | B2 | | 12/2004 | Goeking et al. | |
| 6,837,028 | B1 | | 1/2005 | Miano et al. | |
| 6,840,353 | B2 | | 1/2005 | Arisaka | |
| 6,945,427 | B2 | * | 9/2005 | Hieb | 221/10 |
| 6,972,033 | B2 | | 12/2005 | McNicholas | |
| 6,976,348 | B1 | | 12/2005 | Miano et al. | |
| 7,076,932 | B2 | | 7/2006 | Rubin | |
| 7,210,279 | B1 | | 5/2007 | Ahmed et a | |
| 7,322,172 | B2 | | 1/2008 | Hoffman et al. | |
| 7,412,808 | B2 | | 8/2008 | Lavi | |
| D591,104 | S | | 4/2009 | Oakes | |
| 7,513,089 | B2 | | 4/2009 | Rubin | |
| 7,516,831 | B2 | | 4/2009 | Chang | |
| 7,520,247 | B2 | * | 4/2009 | Rutledge | 119/51.01 |
| 2002/0112445 | A1 | | 8/2002 | Scaduto | |
| 2003/0015824 | A1 | | 1/2003 | Forbes et al. | |
| 2003/0146061 | A1 | | 8/2003 | Tournier | |
| 2004/0045398 | A1 | | 3/2004 | Hayashi | |
| 2004/0045860 | A1 | | 3/2004 | Edgerly et al. | |
| 2004/0089670 | A1 | | 5/2004 | Goeking et al. | |
| 2005/0082307 | A1 | | 4/2005 | Tucker | |
| 2005/0155229 | A1 | | 7/2005 | Lee | |
| 2005/0252057 | A1 | | 11/2005 | Lavi | |
| 2006/0000190 | A1 | | 1/2006 | Behnke et al. | |
| 2007/0108141 | A1 | * | 5/2007 | Smith et al. | 211/49.1 |
| 2007/0131705 | A1 | * | 6/2007 | Behravesh et al. | 221/130 |
| 2007/0193968 | A1 | * | 8/2007 | Smith et al. | 211/70.7 |
| 2008/0121650 | A1 | | 5/2008 | Smith | |
| 2010/0084418 | A1 | | 4/2010 | Reinsel et al. | |
| 2010/0147869 | A1 | | 6/2010 | Iliffe et al. | |
| 2010/0170915 | A1 | * | 7/2010 | Reinsel et al. | 221/279 |
| 2011/0180562 | A1 | | 7/2011 | Reinsel et al. | |
| 2011/0226797 | A1 | * | 9/2011 | Reinsel et al. | 221/97 |

FOREIGN PATENT DOCUMENTS

| | | | |
|---|---|---|---|
| CN | 2865478 | Y | 2/2007 |
| DE | 7033238 | U | 11/1970 |
| DE | 7127677 | U | 11/1971 |
| DE | 3151268 | | 7/1983 |
| DE | 4139938 | A1 | 6/1993 |
| DE | 19906369 | C1 | 2/2000 |
| DE | 202005013647 | U1 | 7/2006 |
| EP | 0856272 | A3 | 1/1999 |
| EP | 1022107 | A1 | 7/2000 |
| EP | 1217923 | B1 | 9/2003 |
| EP | 1358827 | | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| JP | 08-047440 | | 2/1996 |
| JP | 2007-319493 | | 12/2007 |
| KR | 20-1991-0008085 | | 10/1991 |
| WO | 01/05280 | A1 | 1/2001 |
| WO | 01/05281 | A1 | 1/2001 |
| WO | 01/68492 | A1 | 9/2001 |

| | | | |
|---|---|---|---|
| WO | 2004/028309 | A1 | 4/2004 |
| WO | 2007/049982 | A1 | 5/2007 |
| WO | 2007/124606 | A1 | 11/2007 |
| WO | 2008/058187 | A2 | 5/2008 |

OTHER PUBLICATIONS

PCT International Search Report PCT/US2007/083922, Jul. 8, 2008.
Written Opinion of the International Searching Authority for PCT/US2007/083922 of Nov. 17, 2008.
Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
Written Opinion for PCT/US07/83752, mailed Mar. 11, 2008, six pages, European Patent Office, Munich, Germany.
Partial International Search Report, mailed Jul. 8, 2008, two pages.
International Search Report and Written Opinion for PCT/US2009/059915, mailed Feb. 3, 2010, 13 pages, European Patent Office, Munich, Germany.
European Search Report for 06009258.2, mailed Jul. 24, 2006, five pages, Munich, Germany.
Office Action for U.S. Appl. No. 11/415,836, filed May 2, 2006.
Office Actions for U.S. Appl. No. 11/556,808, filed Nov. 6, 2006.
Office Action for U.S. Appl. No. 12/349,203 mailed Jun. 15, 2011.
European Patent Search Report EP 08 01 4387, Oct. 30, 2008.
PCT International Search Report PCT/US2007/083922, Nov. 17, 2008.

* cited by examiner

CUTLERY DISPENSER AND METHOD OF DISPENSING CUTLERY

CROSS-REFERENCE TO RELATED APPLICATIONS

This application claims priority to U.S. Provisional Application No. 60/864,636 filed Nov. 7, 2006, which is herein incorporated by reference in its entirety.

FIELD OF THE INVENTION

The present invention relates generally to dispensers for cutlery, and more particularly to an automated cutlery dispenser and methods of dispensing cutlery therefrom.

BACKGROUND OF THE INVENTION

Disposable cutlery, for example, plastic spoons, forks, knives and "sporks," (e.g., a combination of a spoon and a fork), are frequently used in informal restaurant settings and are provided for use with "take out" restaurant food. To ensure that this cutlery is provided in a hygienic form, it is often purchased by a restaurant or other facility pre-sealed in a pouch. A napkin and condiments i.e., salt and pepper, may be included in the pouch. Such pouches are generally more expensive than the individual utensils due to the processing and materials necessary to form the pouches. Also, these pouches may provide more cutlery or condiments than the user needs and, as such, may be wasteful.

An alternative to such prepared pouches is the presentation of cutlery for use in an unwrapped form, for example, in a bin or cup. As would be recognized, this allows the customer to select only the utensils desired. However, this form of dispensing can be considered by customers to be unsanitary and can indeed be unsanitary if a previous customer does not take a utensil she touched. This method of providing cutlery for use by a consumer can also be unsanitary if a restaurant worker does not conform to the recommended hygiene standards of using gloves when contacting utensils for use by a consumer. The unregulated dispensing of the cutlery in this form also permits the user to take more utensils than intended, thus resulting in less profit for the establishment.

A variety of dispensers have been proposed as an alternative to loose or pouch-packaged cutlery. Previously known dispensers, however, suffer at least the perception of sanitary and hygienic concerns by many users. For example, when cutlery is dispensed into a collection tray, the tray of the dispenser may become soiled as users repeatedly touch the tray while collecting dispensed cutlery. Also, the handles, knobs or other actuators of manually operated dispensers are touched by user after user, causing concern among some individuals. Previously known dispensers also often lack the degree of convenience and economy in operation that would be desirable.

Accordingly, a continual need exists for improved cutlery dispensers that are particularly useful in dispensing disposable cutlery in a hygienic, convenient, economical and non-wasteful manner.

SUMMARY OF THE INVENTION

The present invention relates to dispensers for disposable cutlery and method of dispensing cutlery.

In one embodiment, a cutlery dispenser comprises a storage chamber adapted to retain a plurality of cutlery therein; an ejector for sequentially ejecting the plurality of cutlery from the storage chamber; an actuator for driving the ejector; and a sensor for triggering the actuator in response to an event.

In one embodiment, a cutlery dispenser comprises a storage chamber adapted to retain a plurality of cutlery therein, the storage chamber comprising a storage chute for retaining the plurality of cutlery in a stacked array; a touchless sensor for generating a signal in response to a user; an electronic controller adapted to receive the signal from the touchless sensor and trigger the automated dispenser mechanism in response thereto; and an automated dispense mechanism in operative communication with the electronic controller, the automated dispense mechanism adapted to discharge at least a portion of one of the plurality of cutlery pieces from the storage chute upon triggering by the electronic controller.

In one embodiment, a cutlery dispenser comprises a storage chute for containing a plurality of cutlery, each piece of cutlery having a handle end and a food-contact end; and a dispense mechanism for sequentially dispensing the cutlery one at a time from the storage chute, by presenting the handle end of a dispensed cutlery for retrieval by a user and retaining the food-contact end of the dispensed cutlery until released upon retrieval by the user.

In one embodiment, a cutlery dispenser comprises a storage chamber adapted to retain a plurality of cutlery therein; an ejector for sequentially ejecting the plurality of cutlery from the storage chamber; an actuator for driving the ejector; and an ultraviolet lamp for anti-microbial effect disposed within the storage chamber.

In one embodiment, a method of dispensing pieces of cutlery comprises sensing an input; and automatically dispensing one of a plurality of pieces of cutlery from the dispenser in response to the input.

The above described and other features are exemplified by the following Figures and detailed description.

DETAILED DESCRIPTION OF THE INVENTION

Figure 1:
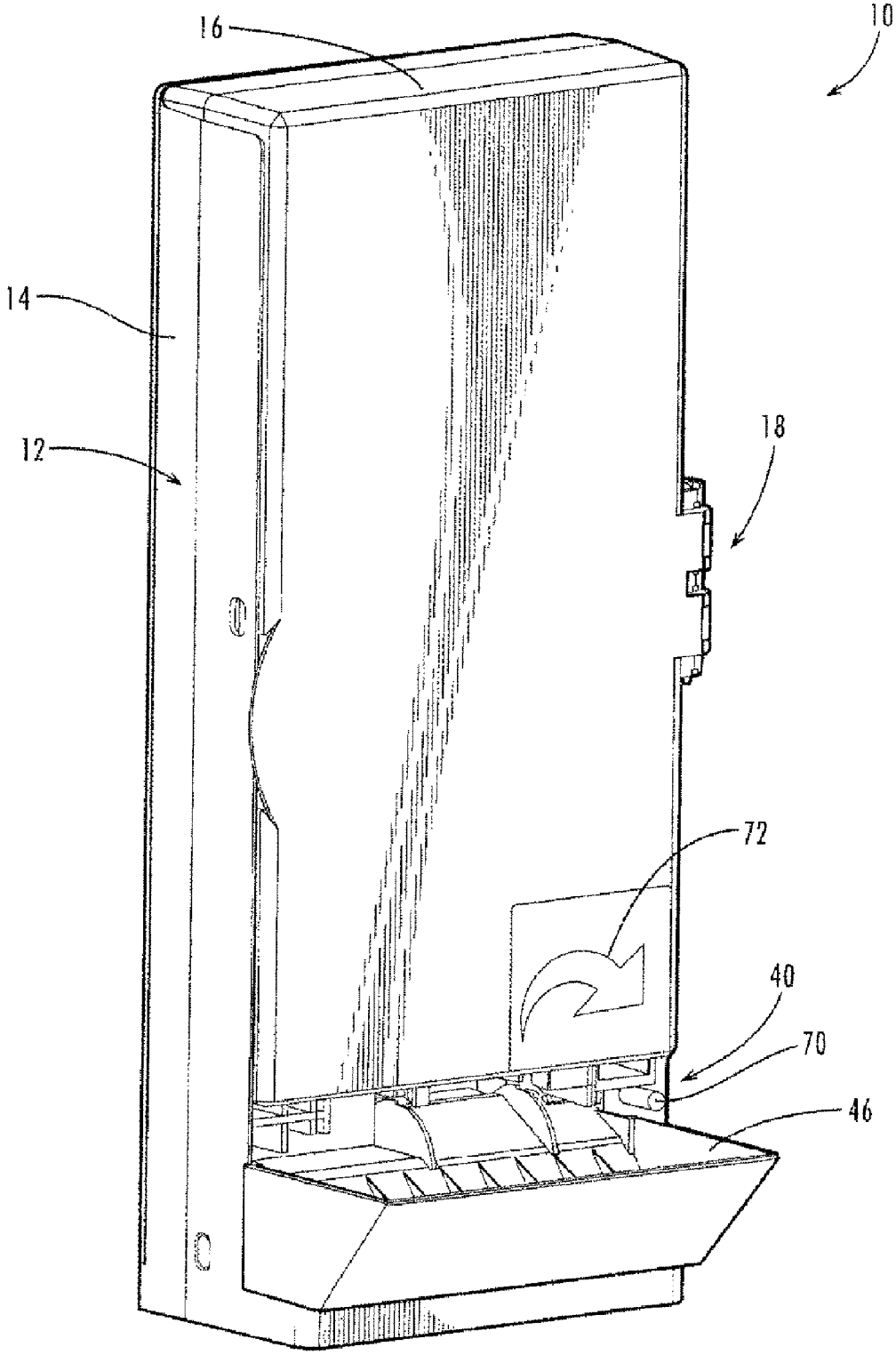
FIG. 1 is a front perspective view of an automated dispenser according to an exemplary embodiment of the present invention.
Figure 2:
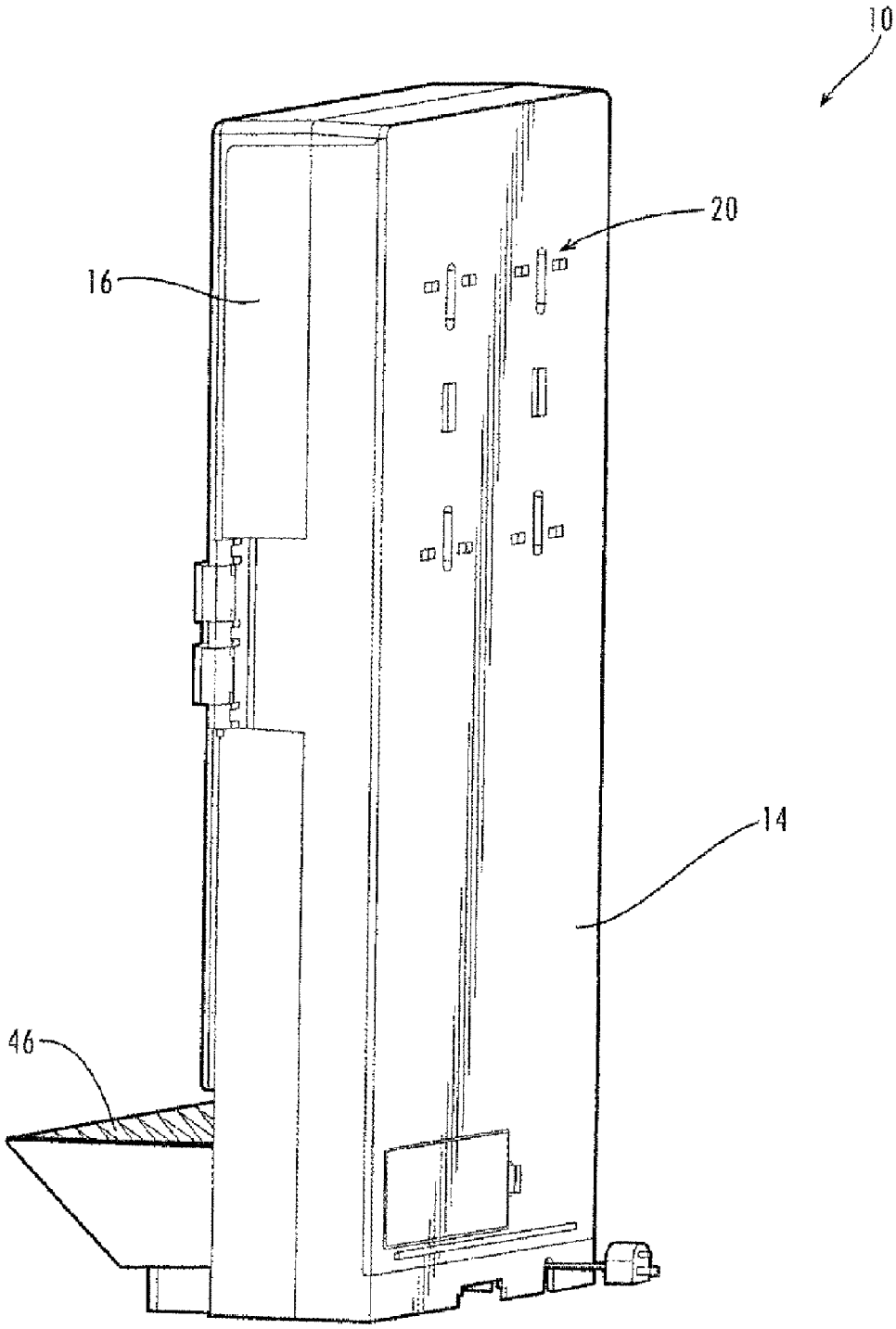
FIG. 2 is a rear perspective view of the automated dispenser shown in FIG. 1.

The present invention may be understood more readily by reference to the following detailed description of the invention and the Figures provided herein. It is to be understood that this invention is not limited to the specific methods, arrangements and conditions described, as such may, of course, vary. It is also to be understood that the terminology used herein is for the purpose of describing particular aspects only and is not intended to be limiting. For example, reference is made throughout this disclosure to disposable cutlery for ease in discussion with the understanding that non-disposable cutlery (e.g., silverware and flatware) may be used in various embodiments.

In this disclosure and in the claims that follow, reference will be made to a number of terms, which shall be defined to have the following meanings.

The singular forms "a," "an," and "the" include plural referents unless the context clearly dictates otherwise.

Ranges may be expressed herein as from "about" one particular value and/or to "about" or another particular value. When such a range is expressed, another aspect includes from the one particular value and/or to the other particular value. Similarly, when values are expressed as approximations, by use of the antecedent "about," it will be understood that the particular value forms another aspect.

"Optional" or "optionally" means that the subsequently described event or circumstance may or may not occur, and that the description includes instances where the event or circumstance occurs and instances where it does not. For example, the phrase "cutlery optionally comprises a stack lug" means that the lug may or may not be present on the cutlery and that the description includes both cutlery having the lug and cutlery not having the lug.

"Disposable cutlery" means any cutlery intended for about one use by the provider thereof although the cutlery can be used more times as desired by the end user. Such cutlery can be comprised totally or substantially totally from polymeric materials, such as polystyrene. The cutlery can comprise fillers, as would be known to one of ordinary skill in the art. Methods of making disposable cutlery are known and are not described in detail herein. Disposable cutlery can also be prepared from filled polypropylene as described in U.S. patent application Ser. No. 10/227,977 (U.S. patent publication No. 2003/0015824), the disclosure of which is incorporated herein in its entirety by this reference.

"Packet" is used to denote a confined arrangement of a plurality of cutlery pieces, where the confined arrangement is suitable for use in a cutlery dispenser, and where the confining medium allows the cutlery to be aligned in the dispenser so that the cutlery can be reliably presented for use. The packet can be a banded stack of cutlery. Alternatively, the packet can be a stack of cutlery where the individual pieces of cutlery are connected together in stack form by, for example, adhesive or tabs or other means for placement within the cutlery dispenser.

"Stack" refers either to a confined configuration of cutlery or an unbound (e.g. unconfined) arrangement of cutlery suitably aligned within a cutlery dispenser as indicated by the context.

Unless the context clearly indicates otherwise, the terms "cutlery" and "utensil" are used herein interchangeably to mean a fork, knife, spoon (including a soup spoon), or spork or other types of cutlery intended to be disposable.

FIGS. 1-5 show an example embodiment of a cutlery dispenser 10 according to the present invention. The cutlery dispenser 10 comprises a housing 12 formed of a back panel 14 and an access door or panel 16 connected to the back panel by one or more hinges 18, or that is removable, for access to internal components thereof. The access door or panel 16 is optionally formed from, in whole or in part, from a transparent or translucent material allowing external visual observation of the internal contents, to monitor the need for restocking of cutlery. The back panel 14 optionally includes one or more mounts or openings 20 for affixing the dispenser 10 to a support or mounting structure, and/or removable panel for accessing internal components. As depicted, the cutlery dispenser 10 is suitable for standalone positioning, as in the serving area of a food court or restaurant; and/or for positioning of multiple dispensers adjacent one another in a side-by-side or top-to-bottom array, with each dispenser distributing a different type of cutlery utensil. Indicia such as graphics and/or text may be provided on the access door 16 or elsewhere, to indicate which type of cutlery utensil is dispensed by which dispenser.

The dispenser 10 is optionally mounted to a support surface by a pivotal coupling, whereby the dispenser can be turned toward a customer area for use and turned away from the customer area for refilling, service, or to prevent pilferage when the establishment is closed. In alternate forms of the invention, the cutlery dispenser 10 is a component subassembly of another apparatus, such as a vending machine for food or beverages incorporating a cutlery dispenser, and the housing or portions thereof may be omitted from the cutlery dispenser itself.

Figure 3:
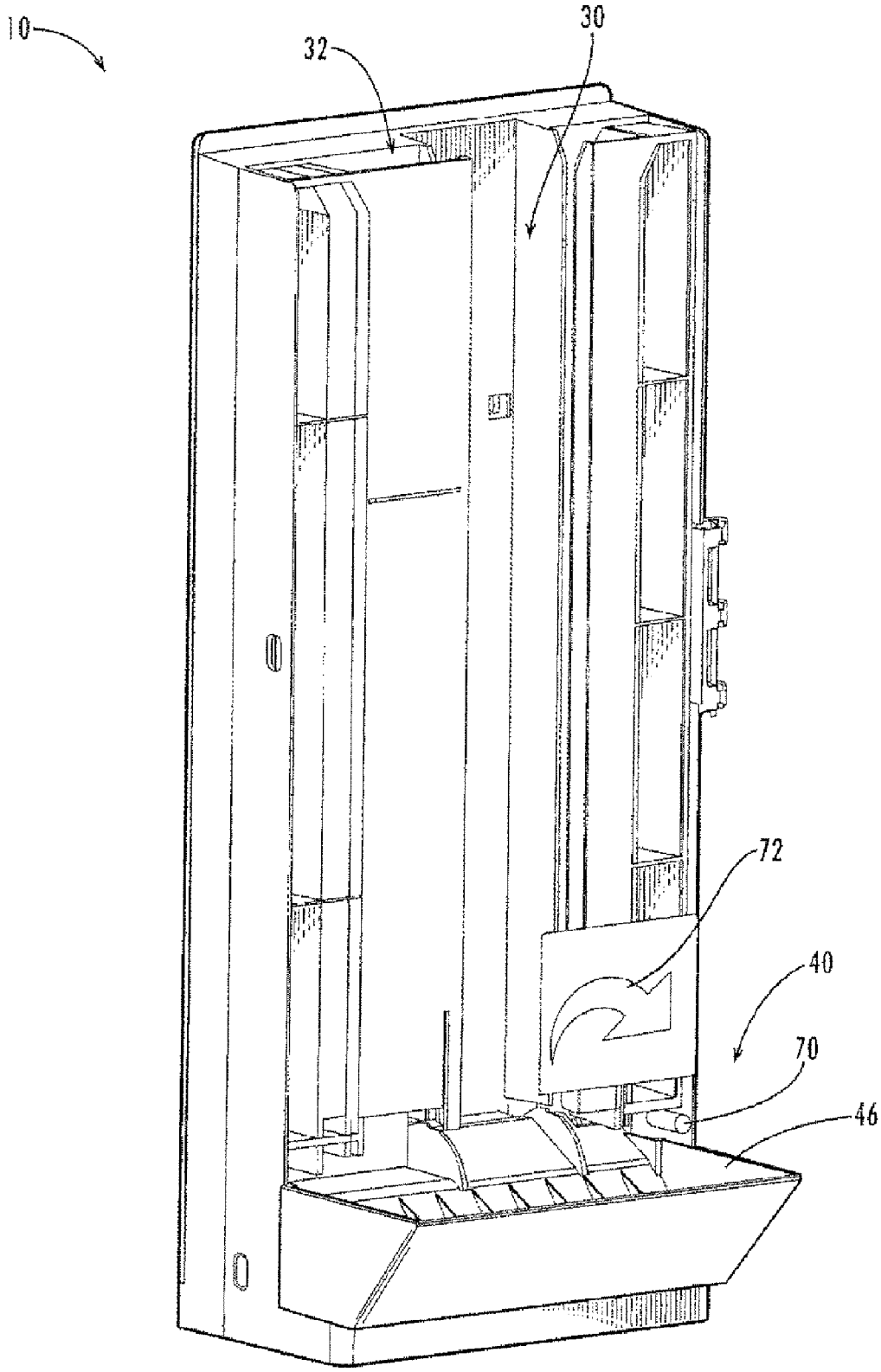
FIG. 3 shows the automated dispenser of FIG. 1 with its restocking door removed to better show internal components.

As seen best with reference to FIG. 3, the cutlery dispenser 10 further comprises a storage chamber in the form of a chute 30 for receiving a plurality of cutlery utensils. The interior profile geometry of the storage chute 30 may be configured to closely match or generally correspond to the exterior profile of a particular type of disposable cutlery utensil, or may be configured for universal use with multiple types of utensils. The rails or channels comprising the storage chute are optionally somewhat flexible and/or are mounted to the housing with some play in their coupling, in order to minimize the incidence of cutlery jamming during dispensing. The storage chute 30 includes a receiver 32 at an upper portion thereof, into which the cutlery is loaded and replenished. In alternate embodiments, the receiver is positioned for loading cutlery from the side, bottom, or other location into the storage chamber. In the depicted embodiment, one or more stacked arrays of cutlery are loaded into the storage chute 3, forming an aligned stack of disposable cutlery in substantial contact with the interior of the storage chute around a perimeter of each cutlery piece. By "in substantial contact" it is meant that the cutlery is not present in the storage chute in a cartridge. The one or more stacked arrays of cutlery can be provided in the form of banded packets of cutlery utensils forming modular units. U.S. Patent Application Publication No. 2007/0193968 having Ser. No. 11/556,808, filed on Nov. 6, 2006, is incorporated herein by reference in its entirety for further understanding of example forms of banded packets of cutlery and dispenser configurations suitable for use in connection with the automated dispenser of the present invention.

The storage chute 30 preferably has a capacity of at least one, and more preferably two or more, of the banded packets or other arrays of cutlery intended to be loaded therein. In alternate embodiments, the storage area or chamber of the cutlery dispenser 10 receives a stack or array of cutlery in a cartridge or other form of container or restraint, or is loaded with individual cutlery utensils in loose quantity.

Figure 4:
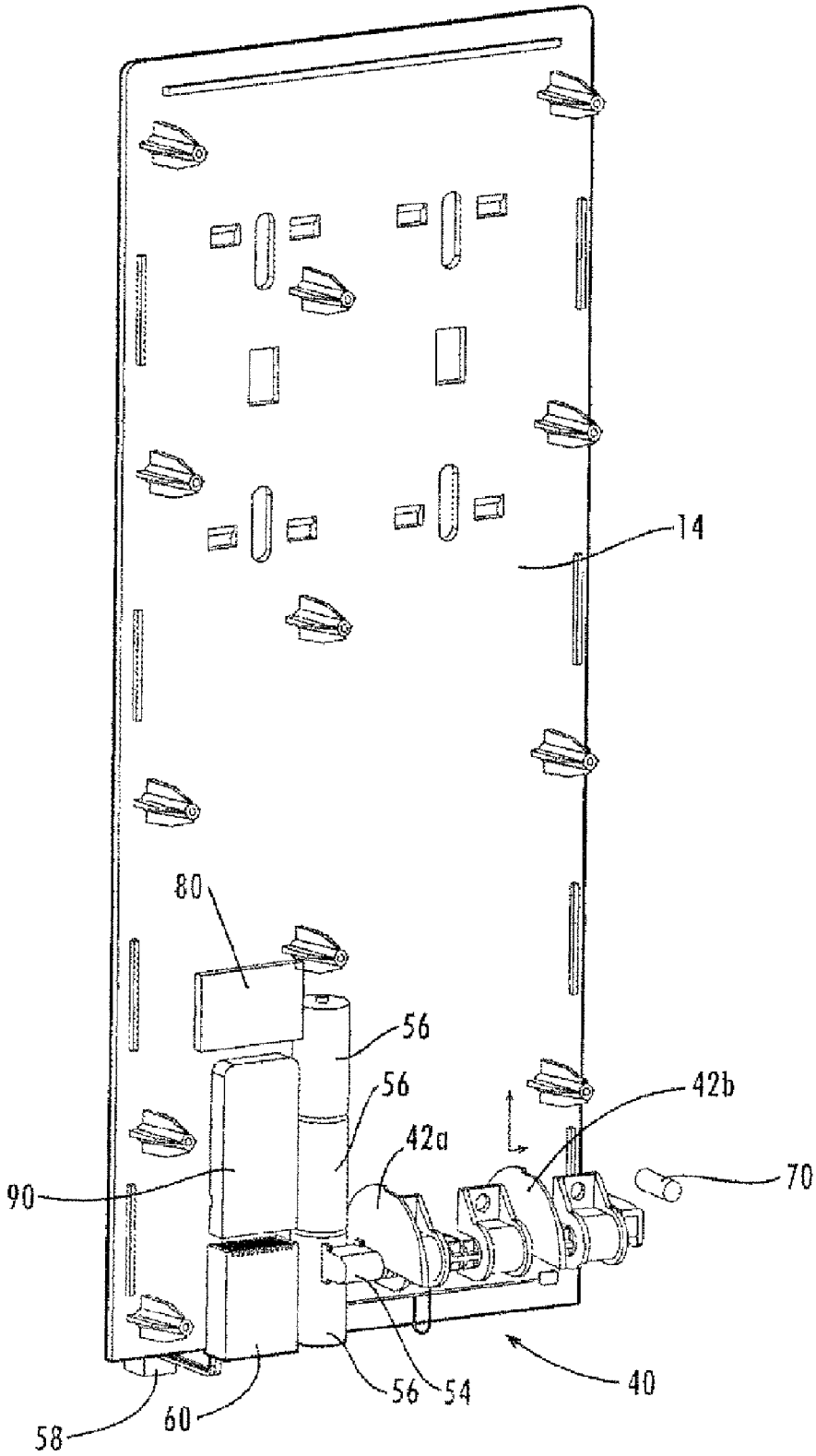
FIG. 4 shows the automated dispenser of FIG. 1 with additional components removed to better show automated dispensing components thereof.
Figure 5:
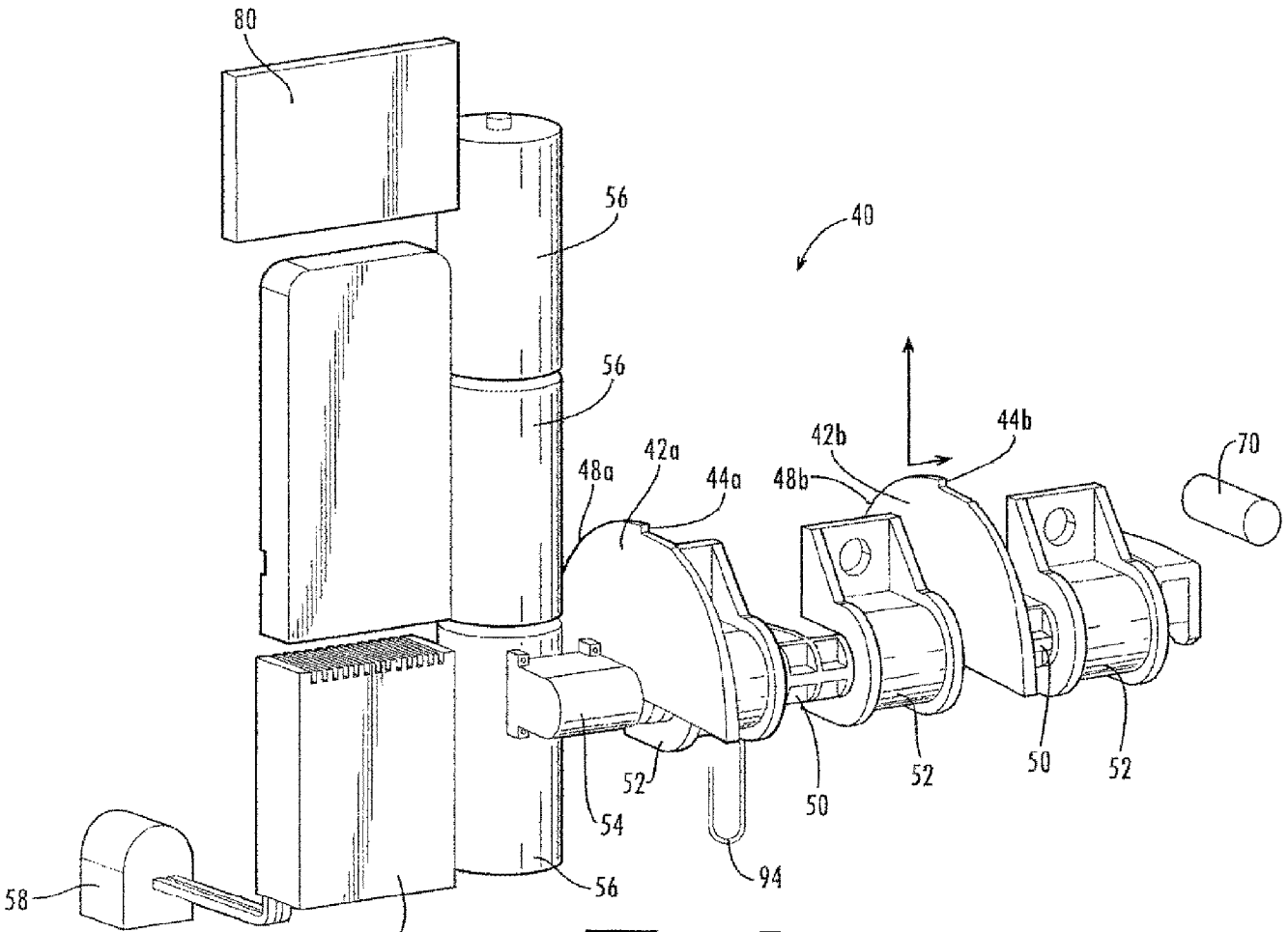
FIG. 5 is a detailed view of the automated dispensing components of the dispenser of FIG. 1.

With reference now to FIGS. 4 and 5, the cutlery dispenser 10 further comprises an automated dispense mechanism 40 for sequentially discharging cutlery utensils one at a time from the storage chute 30 to users. In the depicted embodiment, an ejector comprising one or more cams 42 (first and second cams 42*a*, 42*b* are depicted) having lateral displacement steps or surfaces 44 is positioned beneath the discharge opening of the storage chute 30. Cutlery housed in the storage chute 30 is fed to the ejector under the influence of gravity and/or other biasing means such as one or more springs or pistons, and with each operation of the cutlery dispenser 10, the ejector sequentially engages and at least partially discharges the bottom-most piece of cutlery from the storage chute.

As illustrated, when the ejector is actuated, at least one rocking cam 42 is rotated clockwise forcing the lowermost item of cutlery forwardly from a home position by lateral displacement of the rocking cam 42. The lateral displacement surface 44 of the rocking cam 42 can simultaneously urge the stack of cutlery upward. As the lowermost item of cutlery moves forwardly, the rocking cam 42 rotates counter clockwise back to the home position.

Figure 6:
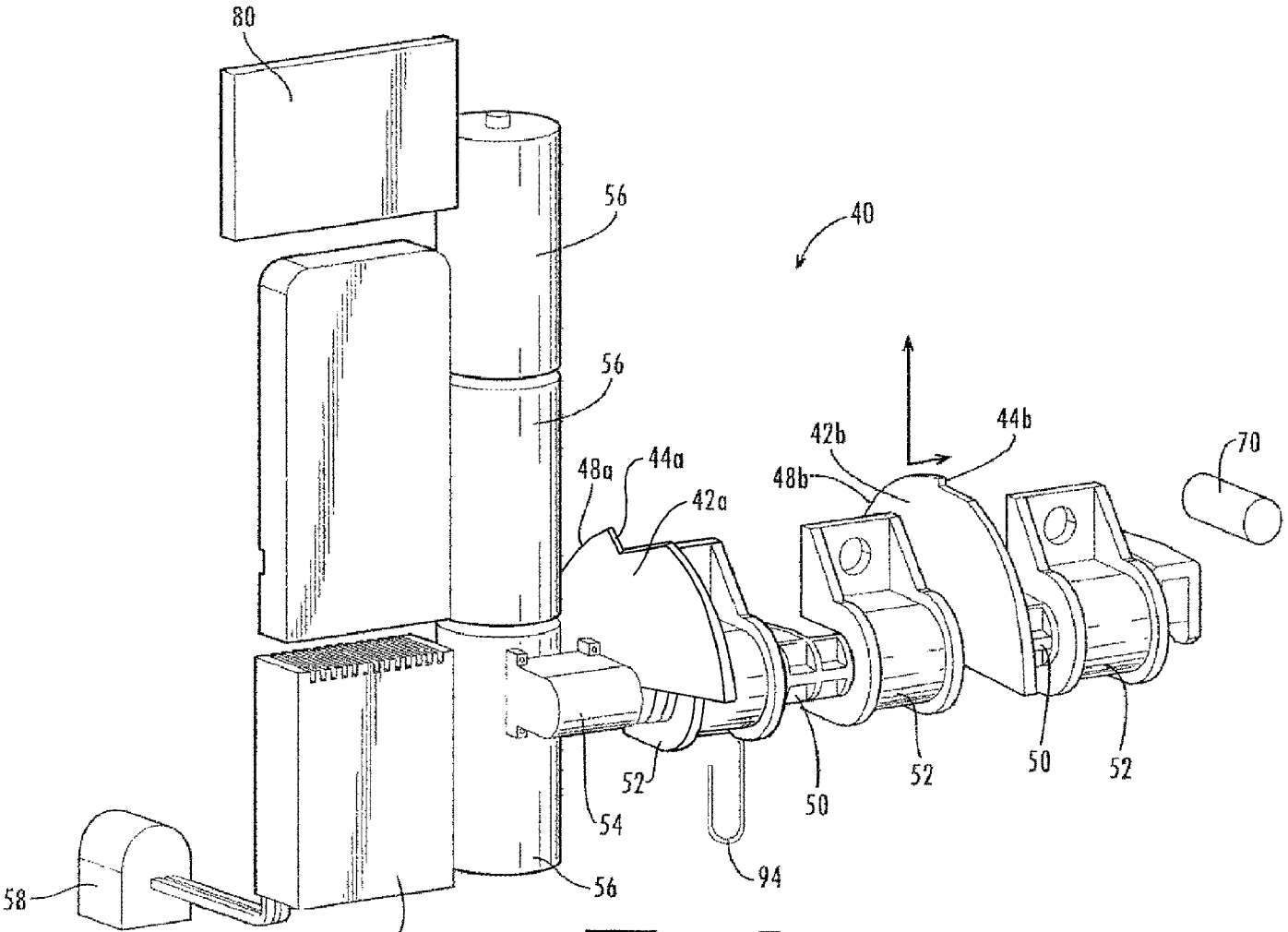
FIG. 6 is a detailed view of an alternate embodiment of the automated dispensing components of the dispenser of FIG. 1.

Optionally, the proximal end or handle portion of the discharged piece of cutlery is presented to the user and the distal end is loosely held in the dispenser for removal by the user. For example, the lateral displacement surface 44*a* of the first cam 42*a* may be offset forwardly or rearwardly in the direction of rotation of the ejector relative to the lateral displacement surface 44*b* of the second cam 42*b* (see FIG. 6), to discharge one end or the other of the discharged piece of cutlery to a greater extent. In this manner, sanitation and hygiene concerns are avoided because users need only touch their selected utensil, which has not previously been exposed to contact by others, and need not touch the dispenser itself. In alternate embodiments, the automated dispense mechanism sequentially discharges the utensils into a collection tray or receptacle 46 optionally mounted to the housing 12 or other structure beneath the ejector. The cam(s) 42 of the ejector optionally comprise one or more eccentric surfaces 48 for jostling the stack of cutlery in the above storage chute 30 upon each operation of the dispenser, to assist in alignment and efficient dispensing. A variety of cam face and lateral displacement surface configurations may be provided within the scope of the invention, each for example adapted for more efficient discharge of a particular cutlery type. In other alternate forms, the ejector may include one or more fingers, lobes, or other ejection members in place of the depicted cams 42.

The one or more cam(s) 42 are mounted to or integrally formed with a driveshaft 50, which in turn is rotationally mounted within a bore or channel through one or more clamps 52 affixed to the housing or other supporting structure. The bearing surfaces of the driveshaft 50 and the bore of the clamps 52 preferably define a close or medium running fit, to maintain accurate positional alignment but allow free and smooth rotation of the shaft. The driveshaft 50 is coupled to a motor 54, which is powered by one or more DC batteries 56, and/or by an external AC power source through a power cord 58 and an AC/DC power converter 60 to actuate the ejector. While a motor is utilized as the actuator in the depicted embodiment, one or more other types of linear or rotary actuators may drive the ejector within the scope of the invention, including without limitation solenoids, electronic actuators, piezoelectric actuators, magnetic actuators, and/or pneumatic or hydraulic actuators.

The motor or other actuator of the cutlery dispenser 10 is triggered to drive the ejector to automatically dispense cutlery in response to a signal generated by a sensor 70 upon recognition by the sensor or an input or event. In example forms of the invention, the sensor 70 is a motion or proximity sensor such as, for example, an infrared or ultrasonic motion detector or a capacitive proximity sensor. A variety of commercially available or specially designed sensor devices may be adapted for use in connection with the dispenser 10, including for example a photodiode having Part No. BCS100C05 manufactured and sold by Sharp Corp. In alternate embodiments, the sensor can be sound transducer for voice or sound actuation, a temperature sensor, a vibration sensor, a light sensor, or other form of sensor or switch for generating a signal in response to an input.

In example forms of the invention, the sensor 70 is a "touchless" or "touch-free" sensor not requiring physical contact by the user to recognize the input and generate a triggering signal in response thereto, thereby further avoiding sanitary and hygiene concerns among users. The range of the sensor 70 can vary depending upon the intended application and the expected proximity of the dispenser 10 to other dispensers or objects, but in example forms will recognize an event or input such as a user passing their hand in front of the dispenser at a distance of about 0.25 inches to about 6 inches away. The sensor is preferably positioned at or near the point of discharge of cutlery from the ejector, which may be located at the front, side, bottom or elsewhere on the housing 12, but alternatively can be located remotely from the discharge. An indicator 72, such as an arrow, a flashing light, text, and/or other indicia can optionally be provided to indicate the sensor location and the manner of operation of the dispenser to a user.

In alternate forms of the invention, the sensor 70 is in communication with a vending machine or other device (of which the cutlery dispenser 10 may or may not be a part), and the dispenser is triggered to dispense cutlery in response to the vending of a product. For example, a cutlery dispenser 10 according to the present invention may be operatively associated with one or more vending machines for dispensing coffee, soup or other food or beverage, and a spoon or other utensil is automatically dispensed upon each sale from the vending machine or only upon sale of specified items requiring a specified type of utensil. In still other forms of the invention, the sensor comprises a contact or non-contact switch activated by a user or by an external device.

The sensor 70 communicates an analog or digital signal by way of a wire, conductor or other electrical, optical, magnetic or electromagnetic communication means, to a processor 80 for controlling the operation of the cutlery dispenser 10. The processor 80 may be any type of computational device including, for example, a microprocessor, a microprocessor, a microcontroller, a programmable logic array, a programmable gate array, an application specific integrated circuit (ASIC), and the like. The control of the cutlery dispenser 10 may be implemented solely in hardware, or in a combination of hardware, software and/or firmware associated with the processor 80. The processor is typically a microcontroller that performs the control algorithm in software, which may be stored in on-board memory in the microcontroller, or in external memory. The memory may be any type of computer-readable medium including, for example, random access memory (RAM), read only memory (ROM), flash memory, compact disks (CDs), digital video disks (DVDs), magnetic disks, magnetic tapes, etc. Signal output from the processor 80 is communicated to a motor controller 90, or alternatively the motor control is integrated in to the processor. The motor controller 90, in turn, delivers power to the motor 54 to drive the cutlery ejector according to a prescribed mode of operation. In the depicted embodiment, the motor 54 actuates the driveshaft 50 and its associated cams 42 in a rocking or pivotal manner, back and forth between a loading position and a discharge position for engaging and discharging sequential pieces of cutlery one at a time from the storage chute 30 upon each operation of the dispenser. A return spring 94 is optionally provided to toggle the ejector back into the loading position. In alternate embodiments, the driveshaft 50 is rotationally driven in a single direction, with each rotation dispensing a single cutlery utensil, or with stepwise rotational increments each dispensing a cutlery utensil such that a single rotation of the driveshaft dispenses two or more utensils.

In an example method of operation, a plurality of disposable cutlery is loaded into the storage chute of an automated cutlery dispenser, or an automated cutlery dispenser is provided already loaded with a plurality of disposable cutlery. To load the dispenser, a door or access panel may be opened or removed, and one or more banded backs of cutlery inserted through a receiver into the storage area of the dispenser. Optionally, the automated dispense mechanism of the dispenser is disabled when the door or access panel is opened or removed, to prevent malfunction and/or waste due to unintended dispensing of cutlery. For example, a positional sensor or relay adjacent the door or access panel may signal the processor to deactivate the actuator when an open position is indicated. Once loaded, the door or access panel is closed and optionally locked using a key or electronic lock, or a hidden release mechanism is provided to prevent unauthorized access to the interior of the dispenser. If the dispenser's power source is not already connected, it is connected at this time. The dispenser may optionally comprise a power switch and/or manual or electronic lockout to prevent unauthorized use, which are activated when ready for use.

When a user needs a piece of cutlery, the dispenser is operated, for example by passing a hand in front of the motion or proximity sensor. The sensor communicates a signal to the processor, which in turn outputs one or more control signals to actuate the automated dispense mechanism and discharge at least a portion of one of the cutlery pieces from the storage chute to be collected by the user. For example, the processor signals the motor controller to operate the motor or other actuator to drive the cam assembly or other ejector through a controlled stroke or motion to eject a handle portion of a utensil for the user to grasp and remove from the dispenser for use.

An interlock may be provided to prevent further operation of the automated dispense mechanism until the previously dispensed utensil is removed by the user, in order to reduce the incidence of jamming. A timer is optionally incorporated into the processor to induce a delay between subsequent operations of the dispenser, to reduce waste. Subsequent users will activate the dispenser in a similar manner, and the dispenser sequentially dispenses cutlery one piece at a time from the storage chute. A refill indicator or alarm is optionally provided to notify service personnel when the sock of cutlery in the storage chute is low and in need of replenishing. Other optional features that may be included in embodiments of the cutlery dispenser within the scope of the invention include lighted marketing or other signage that illuminates when the dispenser is used, and the provision of ultraviolet lamps for anti-microbial effect within the storage and/or dispensing areas.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A cutlery dispenser comprising:

a storage chute for containing a plurality of cutlery, each piece of cutlery having a handle end and a food-contact end; and a dispense mechanism comprising at least two cams, each cam comprising a resting surface and a displacing portion, wherein the resting surface of a first cam is configured to contact a piece of cutlery at a first location and the resting surface of a second cam is configured to contact the piece of cutlery at a different second location, wherein the displacing portion of the first and second cams is configured to discharge the piece of cutlery, and wherein the displacing portion of the first cam is offset relative to the displacing portion of the second cam in a direction of their rotation, wherein the cams are adapted to dispense a piece of cutlery from the storage chute, by presenting a handle end of the dispensed piece of cutlery for retrieval by a user and retaining the food-contact end of the dispensed piece of cutlery until released upon retrieval by the user.

2. The cutlery dispenser of claim 1, wherein actuation of the cams is automated.

3. The cutlery dispenser of claim 2, wherein the automated actuation is initiated in response to a touchless sensor.

4. The cutlery dispenser of claim 1, wherein the displacing portion of the first cam is adapted to contact the piece of cutlery proximal the handle end.

5. The cutlery dispenser of claim 4, wherein the displacing portion the second cam is adapted to contact the piece of cutlery proximal the food-contact end.

6. The cutlery dispenser of claim 1, wherein the cams contact a longitudinal side of the piece of cutlery to be discharged.

7. The cutlery dispenser of claim 1, wherein the storage chute is vertically disposed, and the piece of cutlery is discharged from a lower portion of the storage chute.

8. The cutlery dispenser of claim 1, wherein the storage chute retains the plurality of cutlery in a stacked array.

9. The cutlery dispenser of claim 8, wherein the stacked array of cutlery is loaded in substantial contact with the storage chute.

10. The cutlery dispenser of claim 8, wherein the storage chute comprises a receiver for accepting banded packets of cutlery.

11. The cutlery dispenser of claim 1, wherein the at least two cams are disposed on a driveshaft that is rotated by an actuator.

12. The cutlery dispenser of claim 11, wherein the actuator comprises an electric motor.

13. The cutlery dispenser of claim 3, wherein the touchless sensor comprises a sensor selected from the group consisting of an infrared sensor and a capacitive sensor.

14. The cutlery dispenser of claim 11, further comprising an electronic controller for receiving a signal from the sensor and triggering the actuator in response thereto.

15. The cutlery dispenser of claim 14, wherein the electronic controller comprises a timer for inducing a delay between sequential actuations of the ejector.

16. The cutlery dispenser of claim 14, wherein the electronic controller deactivates the actuator when an access panel of the dispenser is opened for stocking the storage chamber.

17. The cutlery dispenser of claim 1, wherein the cutlery is disposable cutlery.

18. The cutlery dispenser of claim 1, wherein each rotation dispenses a piece of cutlery.

19. The cutlery dispenser of claim 1, wherein two or more pieces of cutlery are dispensed in a single rotation.

* * * * *